United States Patent [19]

Watanabe et al.

[11] Patent Number: 4,462,777

[45] Date of Patent: Jul. 31, 1984

[54] BLOW-MOULDING MACHINE

[75] Inventors: Teishiro Watanabe; Makoto Tsunoi; Toshio Kai; Hiroshi Shiota; Hiroshi Nakabayashi; Tadayoshi Tsutsumi; Ryuichi Sakai, all of Hiroshima, Japan

[73] Assignee: Mitsubishi Jukogyo Kabushiki Kaisha, Tokyo, Japan

[21] Appl. No.: 370,551

[22] Filed: Apr. 21, 1982

[30] Foreign Application Priority Data

| | | | |
|---|---|---|---|
| Apr. 21, 1981 | [JP] | Japan | 56-56526[U] |
| Apr. 22, 1981 | [JP] | Japan | 56-59691 |
| Apr. 24, 1981 | [JP] | Japan | 56-61477 |

[51] Int. Cl.[3] ..... B22C 15/24

[52] U.S. Cl. ..... 425/87; 164/20; 164/21; 164/22; 164/200; 406/92; 425/97; 425/100; 425/103; 425/105; 425/175

[58] Field of Search ..... 425/72 R, 87, 95, 97, 425/100, 103, 105, 175, 458, 584, 449, DIG. 125; 264/517, 518, 561, 121, 6, 7; 164/20, 21, 22, 200; 222/630; 366/107, 10, 11; 406/92; 239/311, 463

[56] References Cited

U.S. PATENT DOCUMENTS

| | | | |
|---|---|---|---|
| Re. 24,716 | 10/1959 | Anselman et al. | 406/92 |
| 1,111,736 | 9/1914 | Conkling | 264/309 |
| 2,794,686 | 6/1957 | Anselman et al. | 406/92 |
| 2,825,107 | 3/1958 | Schueler | 264/121 |
| 3,274,651 | 9/1966 | Oliveira | 164/22 |
| 3,580,326 | 5/1971 | Edwards | 164/200 |
| 3,994,332 | 11/1976 | Kopp | 164/21 |
| 3,998,260 | 12/1976 | Kopp et al. | 164/21 |
| 3,999,592 | 12/1976 | Kopp et al. | 164/21 |
| 4,000,770 | 1/1977 | Brown et al. | 164/21 |

FOREIGN PATENT DOCUMENTS

| | | | |
|---|---|---|---|
| 2035951 | 4/1971 | Fed. Rep. of Germany | 164/200 |
| 1237106 | 6/1971 | United Kingdom | 164/22 |
| 1425565 | 2/1976 | United Kingdom | 164/200 |

*Primary Examiner*—Jeffery R. Thurlow

*Attorney, Agent, or Firm*—Wenderoth, Lind & Ponack

[57] ABSTRACT

A blow-moulding machine comprises a mixer for mixing refractory particles with a binder and a hardener or the like, a main tank for transporting moulding sand, a booster provided subsequently to said tank, a blast hose, and a blowing nozzle mounted at the tip end of said hose.

2 Claims, 8 Drawing Figures

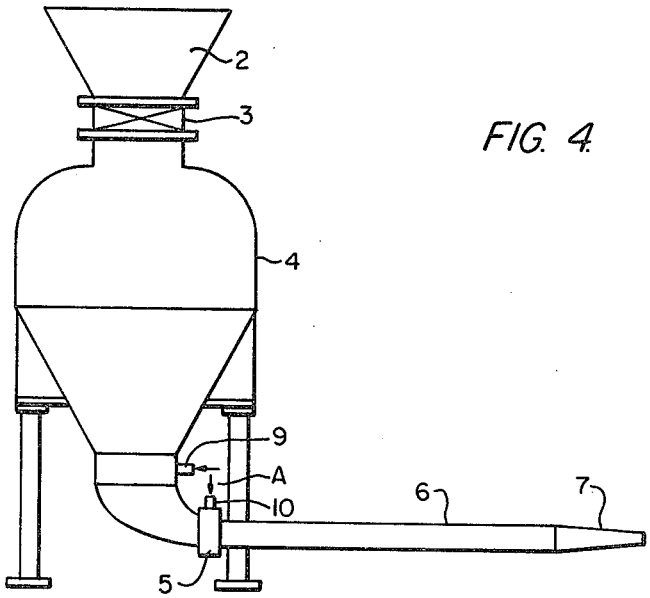
FIG. 4.
FIG. 5.
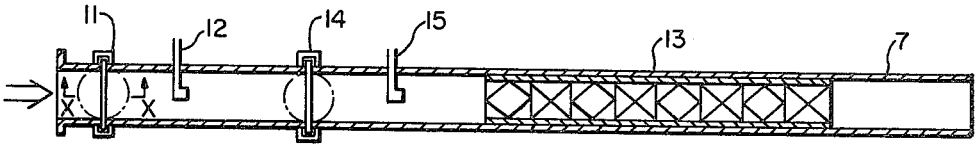
FIG. 6.
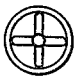
FIG. 7.
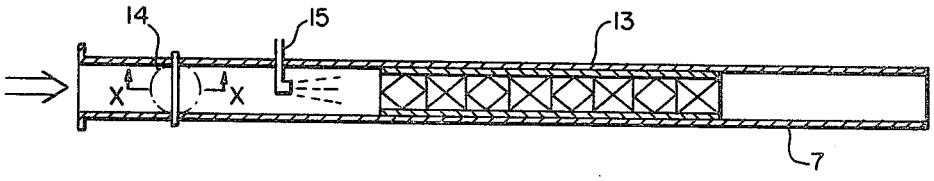
FIG. 8.
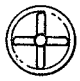

BLOW-MOULDING MACHINE

BACKGROUND OF THE INVENTION

1. Field of the Invention

The present invention relates to a blow-moulding machine to be used in a process for manufacturing a mould by blowing moulding sand onto a pattern surface.

2. Description of the Prior Art

The inventors of this invention previously proposed a blow-moulding process, in which a facing sand layer is formed by blowing onto a pattern surface moulding sand prepared by mixing refractory particles such as silica sand, chromite sand, zirconia sand, etc. with a binder or a binder and a hardener in combination. Subsequently, after back sand is filled in the mould a pattern is removed, and thereby a mould is manufactured.

In an apparatus for mechanically manufacturing a mould, moulding sand has been projected into a flask. A mould is manufactured by hydraulically compressing the moulding sand, but it is not applicable for large-sized bodies or for production of a small number of products. As a representative apparatus for manufacturing a mould by projecting moulding sand, a sand slinger has been known. This apparatus has been used for manufacture of a mould for large-sized bodies or a mould for production of a small number of products. This apparatus is capable of only projecting moulding sand in the vertical direction from above a pattern. It is difficult to project onto the side surface of a pattern, and also it is difficult to form a facing sand layer of an arbitrary thickness.

SUMMARY OF THE INVENTION

The blow-moulding machine according to the present invention has different structures depending upon the properties of moulding sand to be blown. In particular, in the case where moulding sand having a relatively high viscosity of its binder and a long bench life such as moulding sand employing water glass as a binder, is used, it is possible to achieve blowing by means of the blow-moulding machine according to the present invention after the moulding sand has been preliminarily well mixed and adjusted. However, in the case where moulding sand having a relatively high viscosity of its binder and a short bench life such as moulding sand employing furan resin, is used, it is difficult to preliminarily achieve mixing, and consequently, mixing, transportation, and blowing of the mould sand must be carried out in a short period of time within the blow-moulding machine. Moreover, even in such case, if a very small amount of material is added as is the case with a certain kind of catalyzer or hardening accelerator, a long period of mixing is necessary for the purpose of uniform dispersion, and in such case, after the catalyzer or hardening accelerator has been preliminarily mixed, addition of a binder, mixing, transportation of moulding sand, and blowing are carried out in the blow-moulding machine according to the present invention.

The above-mentioned advantages and other objects and features of the present invention will become more apparent by reference to the following description of preferred embodiments of the invention, taken in conjunction with the accompanying drawings.

BRIEF DESCRIPTION OF THE DRAWINGS

FIG. 4 is a schematic side view showing an outline of a blow-moulding machine according to a second preferred embodiment of the present invention, FIG. 5 is a schematic longitudinal cross-section view showing details of the structure of the spray gun included in the blow-moulding machine shown in FIG. 4, FIG. 6 is a schematic cross-section view of a turbulence stimulating plate taken along line X-X in FIG. 5, FIG. 7 is a schematic longitudinal cross-section view showing a modified structure of the spray gun included in the blow-moulding machine shown in FIG. 4, and FIG. 8 is a schematic cross-section view of a turbulence stimulating plate taken along line X-X in FIG. 7.

DETAILED DESCRIPTION OF THE PREFERRED EMBODIMENTS

Now the present invention will be described in greater detail in connection with its preferred embodiments.

Embodiment 1

Figure 1:
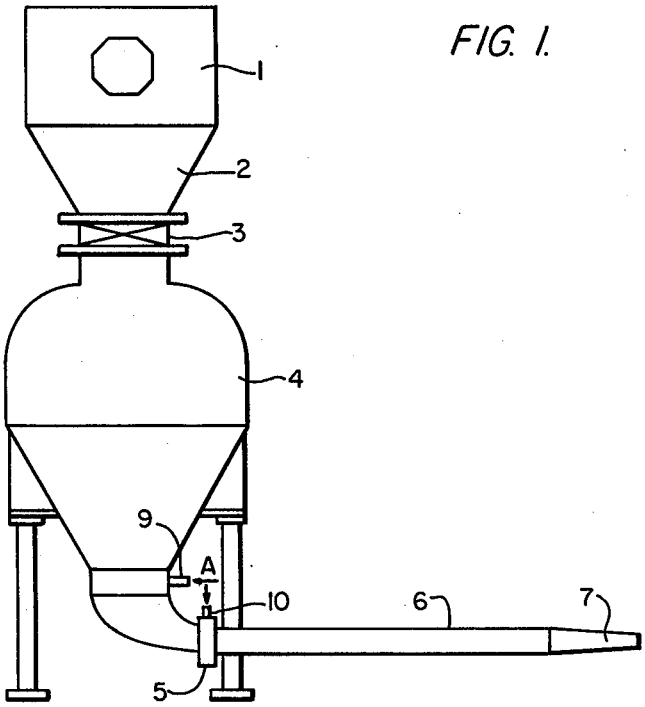
FIG. 1 is a schematic side view showing an outline of a blow-moulding machine according to a first preferred embodiment of the present invention.
Figure 2:
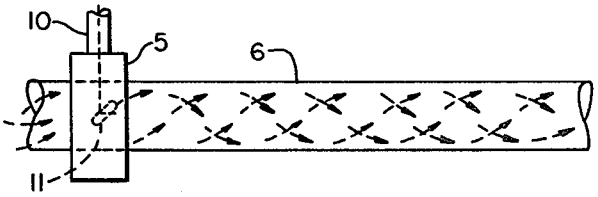
FIG. 2 is an enlarged partial schematic view of a blast hose in the blow-moulding machine shown in FIG. 1.
Figure 3:
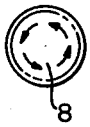
FIG. 3 is a schematic cross-section view of the blast hose in FIG. 2.

A blow-moulding machine according to this embodiment of the invention is applicable to moulding sand employing a highly viscous binder and having a long bench life. As shown in FIG. 1, the blow-moulding machine is constructed of a mixer 1 for mixing refractory particles with a binder and a hardener or the like, a hopper 2, a gate 3, a pneumatic transportation type of main tank 4, a blast hose 6, a booster 5 having a structure adapted to form an air wall for preventing adhesion of moulding sand onto the inner wall surface of the blast hose 6, and a blowing nozzle 7 mounted at the tip end of the blast hose 6. Within a cylindrical surface of the inner wall of the booster 5, there is contained a plurality of nozzles 11 which open approximately in the tangential direction, and provision is made such that, as a result of injection through these nozzles 11 of the air A blasted through an air inlet 10, moulding sand 8 and air A can be driven into revolving motion as shown in FIGS. 2 and 3. Hence, the moulding sand 8 can be transported in a spiral manner through the blast hose 6 coated with an air wall according to the so-called special air curtain flow system. In addition, it is preferable to provide a lining of hard rubber, teflon, etc. which has a low "wetability" on the inner wall surfaces of the tank 4 and hopper 2 for preventing adhesion of moulding sand 8 thereto. In the blow-moulding machine according to the present invention, in the event that it is difficult to associate a mixer 1 at the top of the tank 4, modification could be made such that moulding sand 8 may be adjusted in a separate mixer and then the adjusted moulding sand 8 may be charged into the tank 4.

Now, results of a blowing test conducted under the following conditions by making use of the blow-moulding machine according to the above-described embodiment of the present invention will be presented below.

| | |
|---|---|
| (1) Blending Proportion: | |
| silica sand (AFS No. 44.5) | 100 weight parts |
| phenol-furan resin | 1.0 weight part |
| xylene sulfonic acid | 0.5 weight part |
| zirconia powder | 1.0 weight part |
| (2) Blowing Conditions: | |
| moulding sand ejection rate | 70 Kg/min |
| blowing pressure | 2 Kg/cm$^2$ |
| blowing temperature | room temperature |

After the above-described moulding sand material has been mixed for about five seconds in the high speed mixer 1, it is charged into the tank 4 through the hopper 2, and then the gate 5 is closed. The moulding sand 8 within the tank 4 is transported through the blast hose 6 by blasting air through a first air inlet 9 for pressurizing the interior of the tank and another air inlet 10 for the booster 5, and then it is blown onto a cylindrical pattern surface (1000 mm in diameter × 1000 mm in height) painted with a mould releasing agent, and thereby formed into a sand thickness of about 30 mm. Thereafter, facing sand, runners, etc. are provided within a flask, then back sand is filled in the mould, and a mould is completed by removing the pattern.

When a casting test of cast steel (SC46) was carried out by means of the manufactured mould, a casting having no defect in the cast face or the like could be produced.

Embodiment 2

A blow-moulding machine according to this second embodiment of the present invention is applicable to moulding sand having a short bench life, and this embodiment is characterized in that only refractory particles are charged into a tank 4. In a spray gun 7, a hardener and a binder are injected through separate nozzles to be mixed with the refractory particles. More particularly, as shown in FIGS. 4 and 5, this blow-moulding machine is composed of a hopper 2, a gate 3, a tank 4, a booster 5 having a plurality of nozzles opening in the tangential direction of its inner wall surface, a blast hose 6, and a spray gun 7 which includes, as shown in FIG. 5, a turbulence stimulating plate 11, a hardener injection nozzle 12, another turbulence stimulating plate 14, a binder injection nozzle 15 and a mixing mechanism 13.

With regard to the spray gun 7 adapted to be mounted at the tip end of the blast hose 6 for carrying out blow-moulding, description will be made in more detail with reference to FIGS. 5 and 6.

Referring to FIG. 5, the spray gun 7 is constructed such that the turbulence stimulating plate 11 is disposed therein to stimulate a turbulence in the flow of the refractory particles which are transported through the blast hose 6 while making revolving motion. A hardener injection nozzle 12 is positioned just behind the turbulence stimulating plate 11. Another turbulence stimulating plate 14 is disposed behind the hardener injection nozzle 12 to stimulate a turbulence in the flow of the mixture of the refractory particles and the hardener. A binder injection nozzle 15 is provided just behind the turbulence stimulating plate 14. There is disposed a static mixer 13 for the purpose of enhancing a mixing efficiency for the refractory particles and the hardener and binder in the last step of the process. The static mixer 13 has such structure that helical elements having clockwise and anticlockwise screw threads are alternately disposed within a tube with the end portions may making an angle of 90° with respect to the end portions of the opposed helical element, thereby the flow of the mixture can be divided, reversed and diverted continuously, and so, the mixing efficiency can be remarkably improved.

FIG. 6 is a cross-section view of the turbulence stimulating plate 11 or 14 as viewed in the direction of arrows.

Now a process for carrying out blowing by means of the blow moulding machine according to the present invention, will be explained with reference to FIG. 4.

Refractory particles are charged into the tank 4 through the hopper 2, thereafter compressed air A is blasted through inlets 9 and 10 with the gate 3 closed, and a hardener, if necessary, with a hardening accelerator and a binder are injected simultaneously through the injection nozzles 12 and 15, respectively. The injection rate is preset at a constant-rate pump or the like so that they can be injected at a desired rate depending upon the variety, flow rate, temperature, etc. of the refractory particles. The moulding sand is adjusted in the above-described manner, and then blown onto a pattern surface painted with a mould releasing agent to form a facing sand layer. Thereafter, facing sand, runners, etc. are provided within a flask. Then, after back sand is filled in the mould, a pattern is removed, and thus a mould is completed.

A mould was manufactured by blowing moulding sand onto a cylindrical pattern (1000 mm in diameter × 1000 mm in height) under the following conditions by making use of the above-described blow-moulding machine, and as a result of moulding cast steel (SC46) by means of the manufactured mould, a casting having no defect in the cast face or the like could be produced.

| | | |
|---|---|---|
| (1) Blending Proportion: | | |
| silica sand (AFS No. 44.5) | 100 weight parts | |
| phenol-furan resin | 1.0 weight part | regulated by a constant rate pump |
| xylene sulfonic acid | 0.5 weight part | regulated by a constant rate pump |
| (2) Blowing Conditions: | | |
| moulding sand ejection rate | 10 Kg/min | |
| blowing pressure | 2 Kg/cm$^2$ | |
| blowing temperature | room temperature. | |

Alternatively, in the case where the amount of addition of a hardener or a hardening accelerator is very small and hence a long period is necessitated for mixing uniformly, modification could be made such that refractory particles which have been preliminarily mixed with a hardener or a hardening accelerator are used and a spray gun which lacks a hardener injection nozzle as shown in FIGS. 7 and 8 is used as the blowing gun 7.

As a result of carrying out blow moulding by means of the machine according to the present invention, the following advantages can be obtained:

(1) A process from the mixing of moulding sand to the moulding becomes possible, and so, narrowing of a moulding workshop, great reduction of moulding labor, and energy saving can be achieved.

(2) The subject machine is applicable to middle-sized and large-sized individual castings, and in contrast to the fact that a thickness of a facing sand layer was necessitated to be as thick as 100–300 mm in the prior art although it varied depending upon a size of a casting, according to the present invention, a sufficient mould strength is realized with a thickness of 10–100 mm, so that the amount of facing sand material used can be reduced.

(3) While a mould coating agent was applied on the surface of the facing sand layer to prevent seizure of the mould in the prior art, according to the present invention, since blow moulding is carried out after coating powder has been mixed with the moulding sand, the application work of a mould coating agent can be omitted.

It is to be noted that, in the case of carrying out moulding by making use of the machine according to the present invention, available materials are not limited to those disclosed in connection with the above-described embodiments, but the following materials are also available and examples of standard blending of a corresponding hardener and a corresponding hardening accelerator to various kinds of binders are shown in Table-1:

TABLE 1

| Varieties of Binder | | Examples of Standard Blending: Hardener | Hardening Accelerator | Note |
|---|---|---|---|---|
| Organic | furan resin | organic acid[1] phosphoric acid sulfuric acid | — | Though sulfuric acid is used as a hardener in some cases, it is more frequently added in a minute amount to organic acid for the purpose of enhancing hardening speed. |
| | alkyd resin[2] + mineral spirit | polyiso-cyanate | — | Salt of Co—Sn does not directly take part in a hardening reaction but serves as a catalyst for varying a hardening speed of a binder and a hardener. |
| | phenol resin[3] | polyiso-cyanate | triethyl amine | |
| Inorganic | water glass | Fe—Si powder | — | |
| | water glass | $2CaO.SiO_2$ | — | |
| | water glass | Al powder | — | |
| | sodium sili-cozirconate | | — | |

Note:
[1]xylene sulfonic acid or paratoluene sulfonic acid
[2]linocure mould
[3]isocure mould

What is claimed is:

1. A blow-moulding apparatus comprising:

a tank means for transporting refractory particles, a booster provided subsequently to said tank, a first air inlet means for pressurizing the interior of the tank, a blast hose connected at one end to the booster, a second air inlet means, arranged in the booster, for coating an inner wall surface of the blast hose with an air wall, A spray gun mounted at the other end of said blast hose, and A plurality of nozzles opening in the tangential direction of the cylindrical surface in the inner wall of said booster so that the refractory particles and the air can be driven into revolving motion through the blast hose and the spray gun, wherein said spray gun is provided with a turbulence stimulating plate, a nozzle means for injecting a binder, and a static mixer, arranged successively therein;

whereby adhesion of refractory particles onto the inner wall surface of the blast hose is prevented.

2. A blow-moulding apparatus comprising:

a tank means for transporting refractory particles, a booster provided subsequently to said tank, a first air inlet means for pressurizing the interior of the tank, a blast hose connected at one end to the booster, a second air inlet means, arranged in the booster, for coating an inner wall surface of the blast hose with an air wall, a spray gun mounted at the other end of said blast hose, and a plurality of nozzles opening in the tangential direction of the cylindrical surface in the inner wall of said booster so that the refractory particles and the air can be driven into revolving motion through the blast hose and the spray gun, wherein said spray gun is provided with a first turbulence stimulating plate, a nozzle means for injecting hardener and/or hardening accelerator, a second turbulence stimulating plate, a nozzle means for injecting a binder, and a static mixer, arranged successively therein;

whereby adhesion of refractory particles onto the inner wall surface of the blast hose is prevented.

* * * * *